US005671840A

United States Patent [19]

Glicksman

[11] Patent Number: 5,671,840

[45] Date of Patent: Sep. 30, 1997

[54] VACUUM FORMED ELECTRIC SWITCH SEALS

[75] Inventor: Milton Glicksman, Teaneck, N.J.

[73] Assignee: Multi-Flex Seals, Inc., Hackensack, N.J.

[21] Appl. No.: 503,099

[22] Filed: Jul. 17, 1995

[51] Int. Cl.[6] ..... H01H 19/06

[52] U.S. Cl. ..... 200/302.3; 200/302.2; 264/516

[58] Field of Search ..... 264/516; 200/302.2, 200/302.3

[56] References Cited

U.S. PATENT DOCUMENTS

| | | | |
|---|---|---|---|
| 3,316,379 | 4/1967 | Clarke et al. | 200/302.3 |
| 3,928,742 | 12/1975 | Rule | 200/302.3 |
| 4,021,519 | 5/1977 | Krueger et al. | 264/516 |
| 4,178,806 | 12/1979 | Morse | 74/17.8 |
| 4,298,778 | 11/1981 | Beresford-Jones | 200/302.3 |
| 4,825,023 | 4/1989 | Morse | 200/302.2 |
| 5,035,758 | 7/1991 | Degler et al. | 264/516 |
| 5,100,204 | 3/1992 | Makihara et al. | 264/516 |

*Primary Examiner*—Jan H. Silbaugh
*Assistant Examiner*—Mark Eashoo
*Attorney, Agent, or Firm*—Martin Parkinson

[57] ABSTRACT

A method for fabricating protective seals or "boots" for electric switches, such as push button and toggle switches, is described. In place of traditional rubber molding techniques, the seals are made by thermoforming a plastic film, preferably polyurethane, over a mold containing the nut portion of the seal and pins configured for a suitable shape for toggle or push button switches. Inexpensive stamped, threaded nuts can be employed, and this, together with reduced tooling costs and the efficiency of the method, produce extremely economical electric switch seals. The seals themselves offer unique benefits in that the thin, yet tough, plastic film does not interfere with the functioning of the switches, while providing prolonged service life under difficult conditions. Utilizing clear urethane film, the resultant seals provide clear viewing of the functioning of the switch within.

6 Claims, 6 Drawing Sheets

VACUUM FORMED ELECTRIC SWITCH SEALS

BACKGROUND

This invention relates to protective seals for electric switches, and in particular seals for toggle switches and push button switches. Seals of this type are often referred to as a "boot" seal.

Toggle switches and push button switches are, of course, utilized in a wide variety of applications, often requiring seals so as to make them water proof, dust proof, solvent resistant, and so on. Typically these "boot" seals are made using conventional rubber molding techniques to encase the external surfaces of a metal nut within the rubber. A confluent rubber tube above the nut accommodates the "toggle" or "push button" when the nut is connected by means of uncoated internal threads within the nut to the threaded bearing of the toggle or push button switch. The base of the nut that contacts the panel through which the switch threaded bearing projects, usually has a rubber O ring often formed at the same time as the envelope by having the rubber flow through holes machined in the nut, or by rubber flowing around the nut.

For example, U.S. Pat. No. 4,298,778 discloses a water proof seal for a push button, comprising a shroud of resilient material having a substantially cylindrical portion and being closed at one end, the closed end being collapsible inwardly, and the open end being sealable to the panel. The shroud made out of silicone rubber is considered particularly suitable, with an O ring like structure 13 providing a water proof seal between the mounting panel and the shroud. A feature of the invention being an inwardly collapsible portion of the shroud providing a visual and tactile indication of the position of the push button.

Again, in U.S. Pat. No. 3,316,379 a seal for a push button activated device is disclosed in which the sealing enclosure is formed of a suitable flexible and resiliently deformable material such as rubber. A feature of the invention is a thickened knob centrally located about the axis of the enclosure so that upon application of the actuating force, the walls of the enclosure bulge in a direction away from the push button, and therefore do not interfere with the functioning of the push button.

Another example is discussed in U.S. Pat. No. 4,178,806. In this invention a toggle switch seal is described. The boot element 12 is preferably formed from synthetic resinous materials, as, for example, silicone rubber. A feature of the invention is a convoluted inner wall in which the convolutions are so configured and located that they fold into predetermined area and spaces when the enclosed toggle is moved. These predetermined folds prevent the outer walls of the seal from moving against and thus inhibiting the motion of the toggle lever.

In U.S. Pat. No. 4,825,023 the disclosure addresses the fragile nature of rubber boot elements used to seal push button switches and the like. In this invention a movable aluminum cap 80 and stationary steel cylinder 90 enclose the flexible boot 40. Thus the relatively fragile elastomeric portions of the switch therefore are completely protected and will have an extended service life in relation to the more common type of sealing apparatus which does not, in any way, protect or cover the relatively fragile elastomeric sealing materials.

While the above described devices provide useful improvements in boot type electric switch seals, they do not address the unique method for fabricating these seals disclosed in the instant invention, and the resulting new electric switch seals.

It is therefore a primary object of the invention to provide an economical method for fabricating electric switch seals.

An additional object is to reduce tooling costs for the fabrication of electric switch seals.

Another object is to provide an inexpensive electric switch seal relative to currently available seals of this type.

A further object is to provide an electric switch seal which permits clear viewing of the switching mechanism protected by the seal.

Still another object is to provide an economical yet inherently long lasting seal for toggle switches and push button switches.

SUMMARY

These and other objects are obtained in the instant invention for fabricating electric switch seals. As discussed above, typically in the past standard rubber molding techniques have been employed to provide effective seals for toggle switches and push button switches against attack by water, solvents, dust, and so on. To begin with, a relatively costly screw-machined nut, having a special shape or holes to allow rubber to flow through or around the nut, is encapsulated in a rubber formulation, such as, for example, silicone rubber. A confluent tubular extension is formed at the same time to extend above the nut to provide an enclosure for the push button or toggle portion of the switch. The resultant switch seal or boot can be relatively expensive to fabricate. In addition, the boot is usually opaque either due to the opaque rubber used for encapsulation, or for reasons of economy in fabrication. Further, the rubber construction can be relatively fragile for the rigorous uses often employed for electric switches of this type.

I have found that by using the method known as vacuum forming, electric switch seals for toggle switches and push button switches can be fabricated at significant production economies. In addition, the resultant product produces superior operating characteristics to the more common seals of this type that are currently available. In the vacuum forming process, a thermoformable sheet of plastic is placed over an object, the sheet is heated to its softening point, a vacuum is drawn between the sheet and the object so that atmospheric pressure causes the sheet to deform and flow over and take the shape of the object.

In the instant invention, I have found that even thin sheets of polyurethane, as, for example, 0.015"–0.020" in thickness, can be vacuum formed to yield toggle and push button switch seals with unique characteristics, of high quality, and at significant reduction in cost of fabrication. The method of the invention employs a mold having a practical number of upraised pins in the shape of the particular boot to be formed. The number of pins can be, for example, 50 or 60. The mold itself can be fabricated in standard materials, including steel, plastic, or wood. The pins are generally tubular in shape, having a base connected to the planar surface of the mold, and an enclosed top portion. The diameter of this tubular shape is larger, at a point beginning with the planar surface of the mold and extending a spaced distance above the surface of the mold, than the remainder of the tubular portion of the pin, the purpose being to provide a shoulder for a nut to be positioned on prior to the process of vacuum forming. The mold is provided with holes through its surface, the holes being connected to a central manifold, which in turn is connected to a source of vacuum.

To fabricate the seals of the invention, metal nuts are placed over the tubular pins extending upward from the mold, each nut being secured on the shoulder provided by the enlarged pin diameter area near the surface of the mold. It is to be noted that in sharp distinction to the standard rubber molding process in which specially shaped, screw-machined nuts must be employed, in the method of the instant invention inexpensive, stamped, threaded nuts can be employed. A sheet of polyurethane plastic is then placed on the mold over the pins; the sheet of polyurethane plastic is heated to its softening point using conventional vacuum forming techniques, and the source of vacuum is applied to the mold. Atmospheric pressure then causes the sheet of polyurethane plastic to take the shape of the pins on the mold, and, in doing so, to totally encapsulate all of the external surfaces of the pins in polyurethane plastic.

The sheet of polyurethane is then stripped off of the mold and the now formed polyurethane sheet is placed on a flat bed press for the final process of simply cutting a circle around each of the pins by means of a multiplicity of cutting circles in a steel-rule die to free each of the now formed seals from the remainder of the polyurethane sheet.

The resultant nut encapsulated seal or boot is the finished product. Although extremely thin so as not to interfere with the proper functioning of a toggle or a push button, the superior tensile and tear strength of polyurethane plastic sheet over conventional rubbers assures long term usage of the seals, even under unusually demanding applications. The polyurethane sheet can be supplied opaque, or in various colors. For this application, utilizing the natural clarity of polyurethane film is preferred since it provides an unobstructed view as to the functioning of the toggle switch or push button switch within the seal.

Thus the method of the invention provides a newer, attractive, low cost, and long lasting electric switch seal than was heretofore available. While the preferred embodiments described above denote polyurethane as the thermoforable plastic sheet, obviously a variety of other thermoplastic sheet materials can be similarly employed. The nut portion of the seal is described as being made of metal, but, of course, nuts fabricated in plastic may also be utilized.

DETAILED DESCRIPTION

Figure 1:
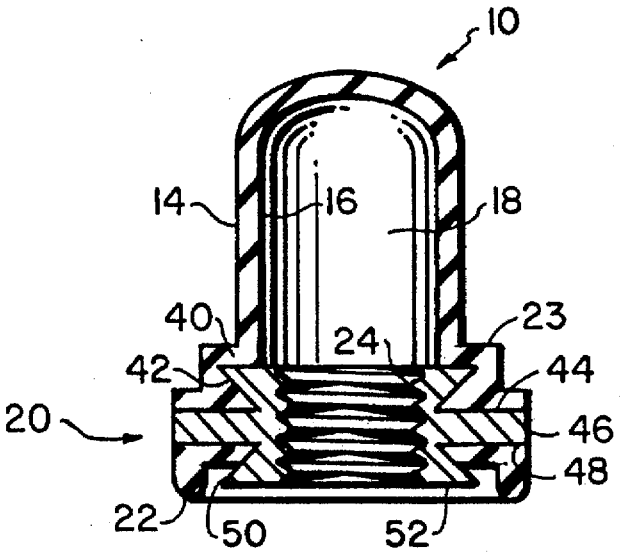
FIG. 1 PRIOR ART
FIG. 1 is a perspective, sectional view of a prior art push button type switch seal.
Figure 1A:
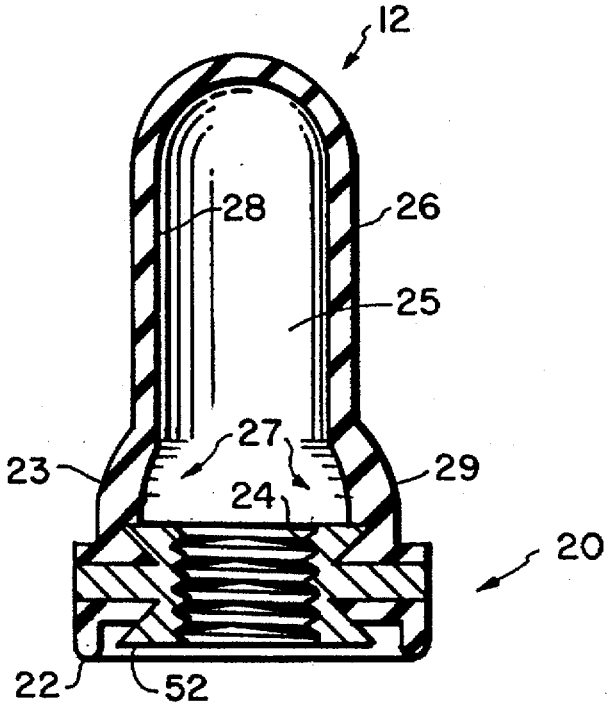
FIG. 1A PRIOR ART
FIG. 1A is a perspective, sectional view of a prior art toggle switch type switch seal.

Referring now to the drawings wherein similar structures having the same function are denoted by the same numerals, FIG. 1 illustrates a typical prior art version of a switch seal 10 for a push button type of electric switch. A nut 20, which is usually a specially fabricated screw-machined nut so as to accommodate the conventional rubber molding techniques, is depicted. The screw machined nut 20 has a top planar surface 40 and a bottom planar surface 52 with an internal threaded bore 24 running from the top to the bottom. Tapered surfaces 42 and 50 on the nut connect to intermediate horizontal surfaces 44 and 48, which together form a polygonal external surface 46. The top external surface 40 of the nut 20 is shown coated with rubber 23, with a rubber O ring like structure 22 adhering to the lower intermediate horizontal surface 48 and the lower tapered surface 50 of the nut 20. A closed end rubber tube, having an outer wall 14 and an inner wall 16 defining a space 18 for enclosing a push button type switch, is confluent with the external rubber coating 23 on the nut. Internal threads 24 within the nut remain free of the rubber coating so as to be available for direct connection to a threaded upstanding flange portion (100-FIG. 7) of the push button switch. Securing this switch seal 10 to a push button type switch provides liquid proof and dust proof protection for the switch. FIG. 1A illustrates a typical prior art switch seal 12 for a toggle type of electric switch. The same type of nut 20 is shown having an O ring like rubber structure 22 at its base, with its upper surface coated with rubber 29. A closed end rubber tube having an outer wall 26 and an inner wall 28 is confluent with the rubber coating 29 on the upper surface of the nut 20 and defines an enlarged area 27 immediately adjacent the nut, with a confluent narrower area 25 extending upwards from the nut. The narrower area 25 within the rubber tube is to accommodate a toggle switch (104-FIG. 7), with the lower, enlarged area 27 of the rubber tube acting as a stress release area when the toggle switch is moved from one position to another.

Figure 2:
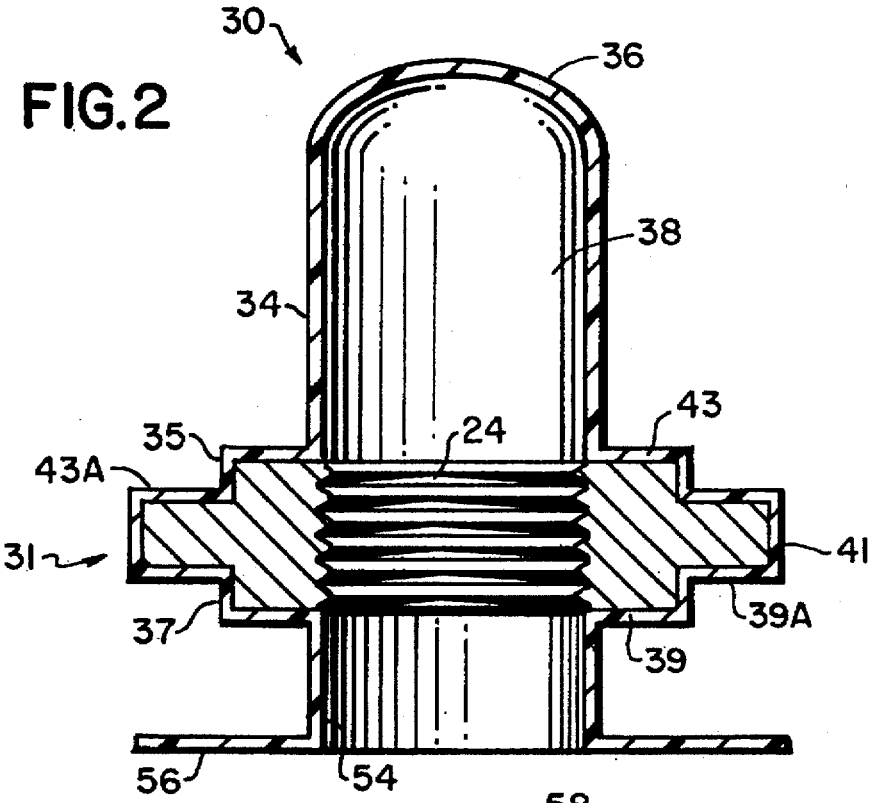
FIG. 2 is a perspective, sectional view of one version of the switch seal of the invention for sealing a push button type switch.

FIG. 2 illustrates one version 30 of the switch seal of the invention for providing protection for a push button type switch. For the process of the invention an inexpensive, stamped machine nut 31 in contrast to the more complicated structure of the screw machined nut 20 usually found necessary for the standard rubber molding techniques of the prior art. The seal 30 is depicted after the complete fabrication process has been performed. The stamped machine nut generally indicated as 31 has a top planar surface 43 and a bottom planar surface 39, with an internal threaded bore 24 running from the top to the bottom. Vertical surfaces 35 and 37 on the nut connect to intermediate horizontal surfaces 43A and 39A, which together form a polygonal external surface 41. The nut 31 is generally metal, often being fabricated in brass, but can, of course, be fabricated in other metals, such as stainless steel, or even in various plastic materials. After the vacuum forming process which will be more fully described, external nut surfaces (43, 35, 43A, 41, 39A) are encapsulated in a thin film of a thermoplastic material (70-FIG. 3) such as, for example, polyurethane. The film extends upwards from the upper planar surface 43 of the nut to form a generally tubular shaped enclosure having an upstanding side wall 34 and a domed shaped closed end 36, defining an area 38 for enclosing a push button switch (106-FIG. 7A). If, for example, the film is a clear polyurethane film, the actions of the push button switch within the seal will be fully visible to a user of the seal-push button combination. A vertical film wall 54 extends from the bottom planar surface 39 of the nut, and is confluent with a horizontal shelf 56 of film which extend slightly beyond the external polygonal surface 41 of the nut.

Figure 2A:
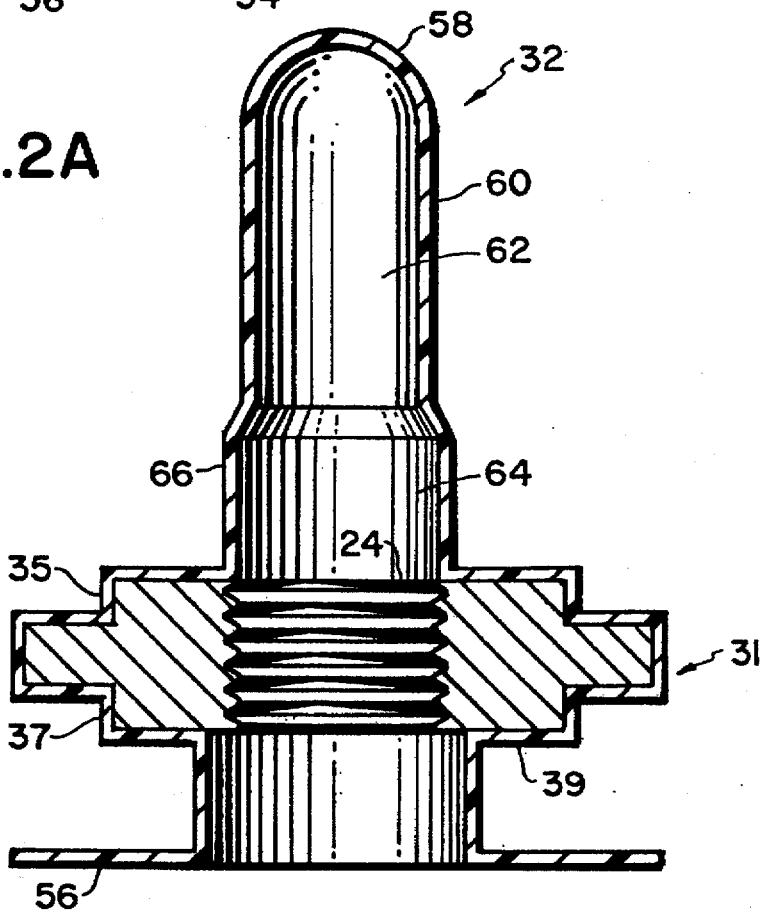
FIG. 2A is a perspective, sectional view of one version of the switch seal of the invention for sealing a toggle switch type switch.

FIG. 2A illustrates a similar version 32 of the invention as depicted in FIG. 2 except being configured for accepting a typical toggle switch (104-FIG. 7) in place of the push button switch. In this case, after the completion of the fabrication method of the invention, a generally tubular shaped portion of the thermoformed film 70 extends above the upper planar surface 43 of the nut 31. This tubular portion has a larger diameter portion immediately adjacent the nut, having an upstanding side wall 66 defining an area 64 within the tubular portion. This larger diameter area is confluent with a smaller diameter portion having a side wall 60 defining an area 62 within this tubular portion, this smaller diameter portion having a dome shaped closed end 58. The purpose of the smaller diameter area 62 of this switch seal is to provide an enclosure for the toggle portion of a toggle switch, while the larger diameter area 64 provides a measure of strain relief when the toggle switch is moved form one position to another.

Figure 3:
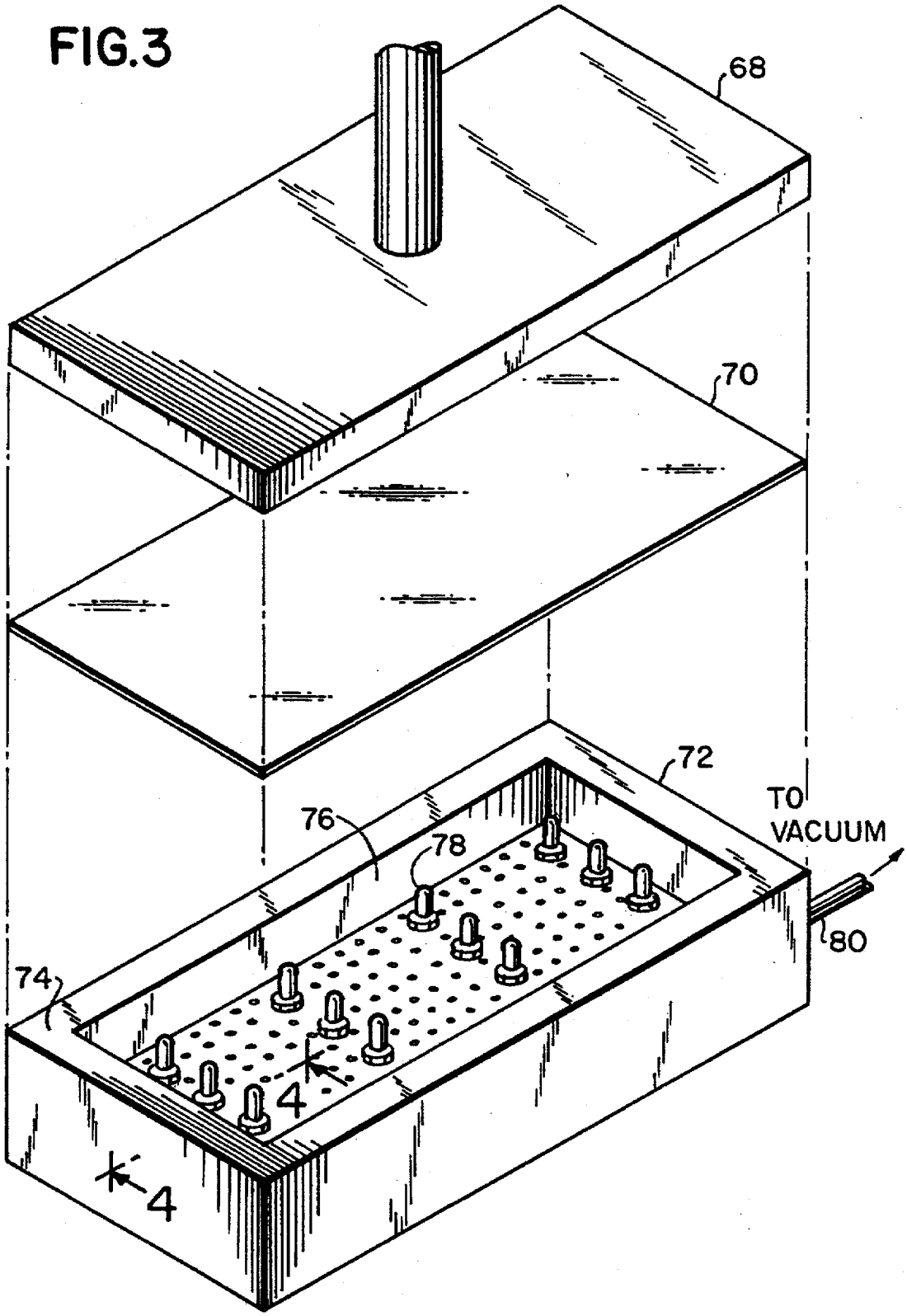
FIG. 3 is an exploded view of a typical vacuum forming machine for forming the electric switch seals of the invention.

In FIG. 3 a typical vacuum forming apparatus is depicted. A mold 72 contains a top planar shelf 74, and a recessed planar surface 76 joining an intermediate planar surface 77 containing the pins 78 which provide the shape on which the thermoplastic film is to be formed. The base of the mold has a tube 80 which provides a connection to a suitable source of vacuum, such as a vacuum pump (not shown). A hot plate 68 provides the means for heat softening the thermoplastic film 70. One preferred example of a thermoplastic film would be clear polyurethane, having a film thickness of between 0.015"–0.020". Obviously other thicknesses of film can be employed depending on the application, and, of course, other types of thermoplastic films, including polyolefins, fluorocarbons, etc. To form the seals of the invention, the film 70 is set in place on the shelf area 74 of the mold, and the hot plate 68 then heats the film to a point where it will easily deform over the shapes 78 within the mold. Once the film is sufficiently softened, the source of vacuum is turned on which causes the air to be evacuated between the film and the recessed planar area of the mold. Atmospheric pressure then deforms the softened film over the pins 78 on the surface of the mold.

Figure 4A:
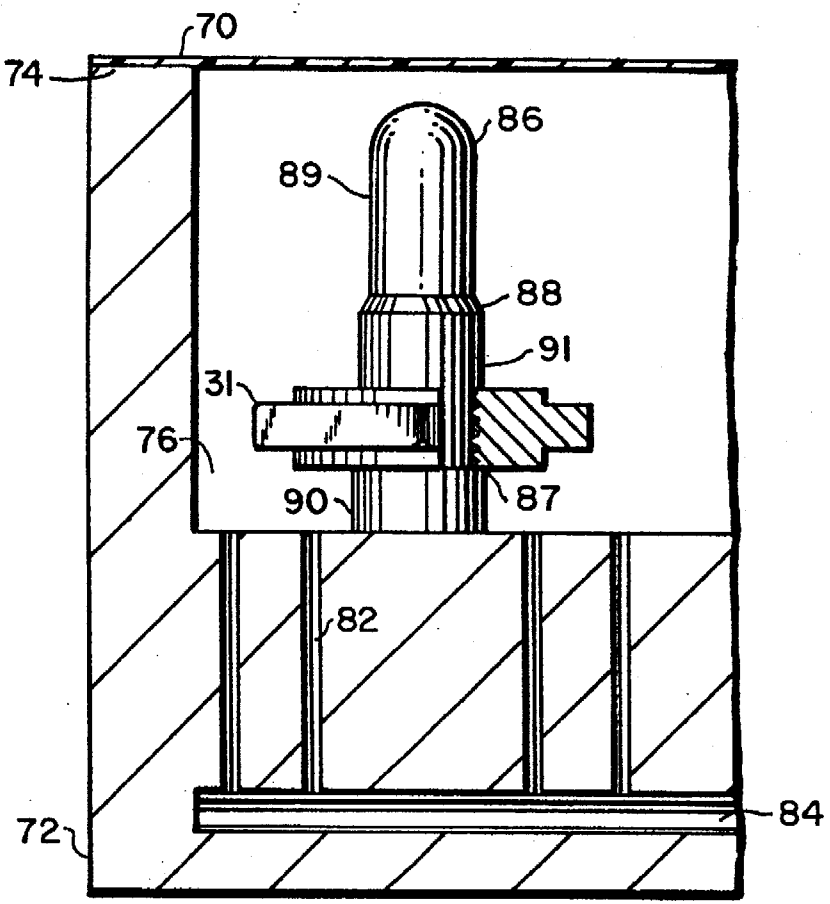
FIG. 4A is a similar view to that of FIG. 4, illustrating the shape of the pins for forming the toggle switch type switch seals.
Figure 4:
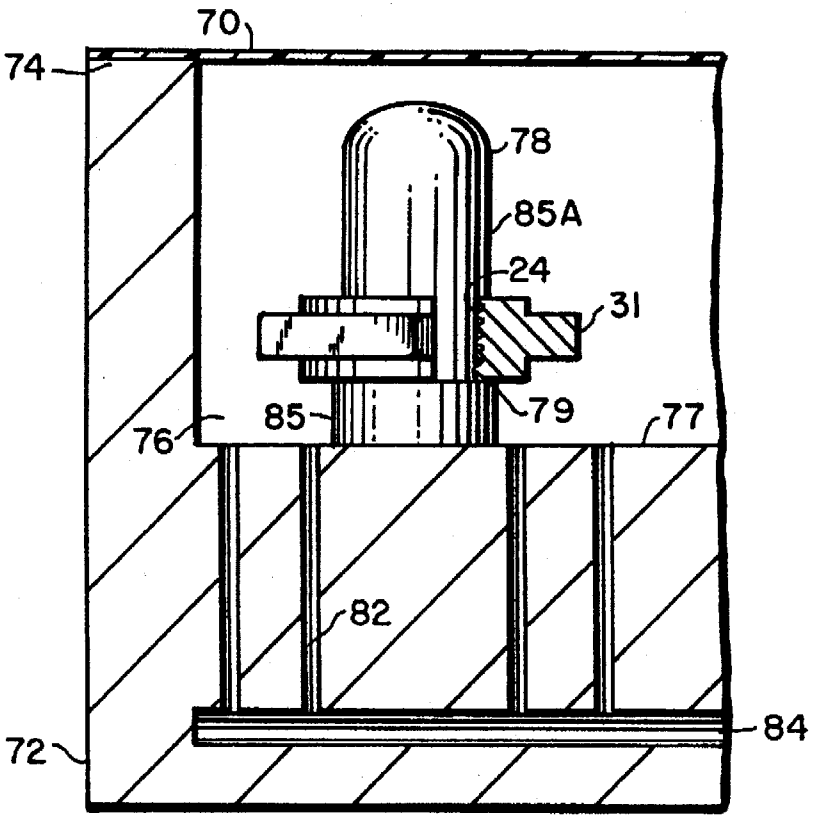
FIG. 4 is a perspective, sectional view of the mold containing the pins for forming the push button type switch seals, with the nut being secured to the pin, as taken through lines 4—4 of FIG. 3.

FIGS. 4 and 4A are sectional views of the mold 72 and pins 78 and 86 showing the nut 31 in place on each of the pins. In FIG. 4 a pin 78 for forming the seal 30 for enclosing a push button type switch is depicted. The pin is in the shape of an enclosed tube with a larger diameter portion 85 immediately adjacent the recessed planar surface 77 of the mold, said larger diameter area forming a shoulder area 79 with an upwardly extending smaller diameter portion 85A. The nut is placed over the smaller diameter area of the pin, being secured in place on the shoulder area 79 with the internal threads of the nut facing the outer surface of the smaller tubular portion 85A. Lines 82 depict air passages between the surface of the mold 77 and an air channel 84 within the mold, said air channel being connected to the outlet tube 80 in the mold which in turn is connected to a source of vacuum.

FIG. 4A is a similar view to FIG. 4 depicting a pin 86 in place on the surface 77 of the mold for forming the seal 32 for enclosing a toggle switch type of switch. In this case the pin 86 is tubular in shape, having a first portion 90 immediately adjacent the surface of the mold being larger in diameter than a confluent second tubular portion 91 defining a shoulder area 87 at the juncture of said first and second tubular portions. A third tubular portion 89 extends confluent with the second tubular portion, this third tubular portion being smaller in diameter than said second tubular portion, a shoulder area 88 being defined at the juncture of the second tubular portion 89 and the third tubular portion 89. As depicted also in FIG. 4 a nut is shown in place on the pin 86 secured above the surface area 77 of the mold by means of the shoulder area 87 between the first and second tubular portions.

Figure 5:
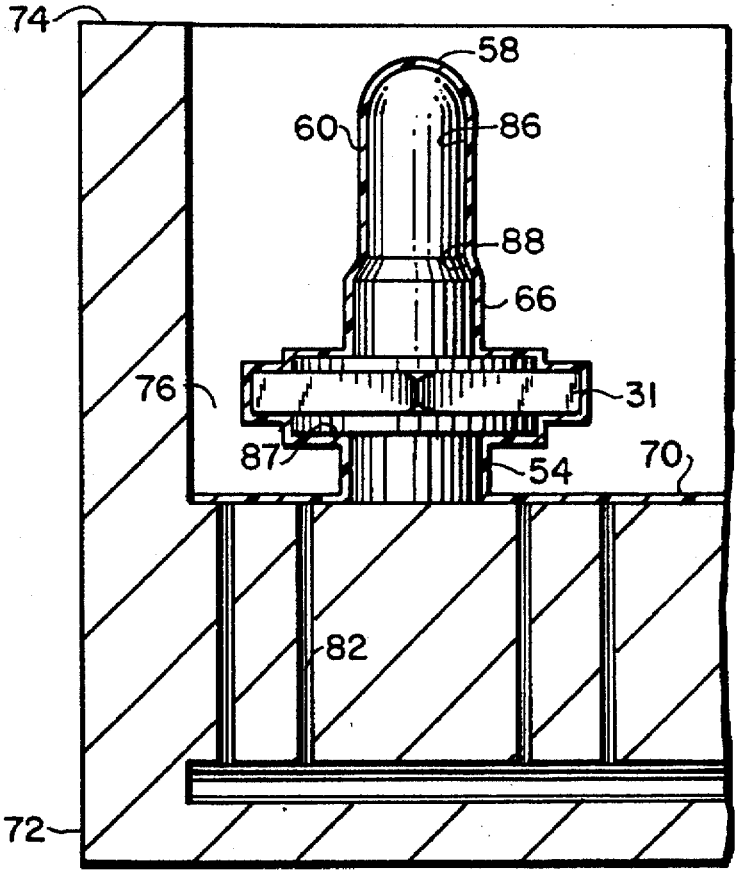
FIG. 5 is a similar view to that of FIG. 4A, illustrating the completion of the vacuum forming process, with the thermoplastic sheet now formed about the pin and the nut within the mold.

FIG. 5 illustrates the completion of the vacuum forming method of the invention. The thermoplastic film 70 is shown having been softened by heat, and deformed by atmospheric pressure (when air was evacuated between the film and the recessed surface 77 of the mold via air passages 82 in the mold connected to air channel 84, the vacuum connection tube 80 and a source of vacuum) so as to take the shape of the pin 86, and envelope all of the external surfaces of the nut exclusive of the internal threads. At this point the thermoformed film 70 is peeled away from the mold (not shown).

Figure 6:
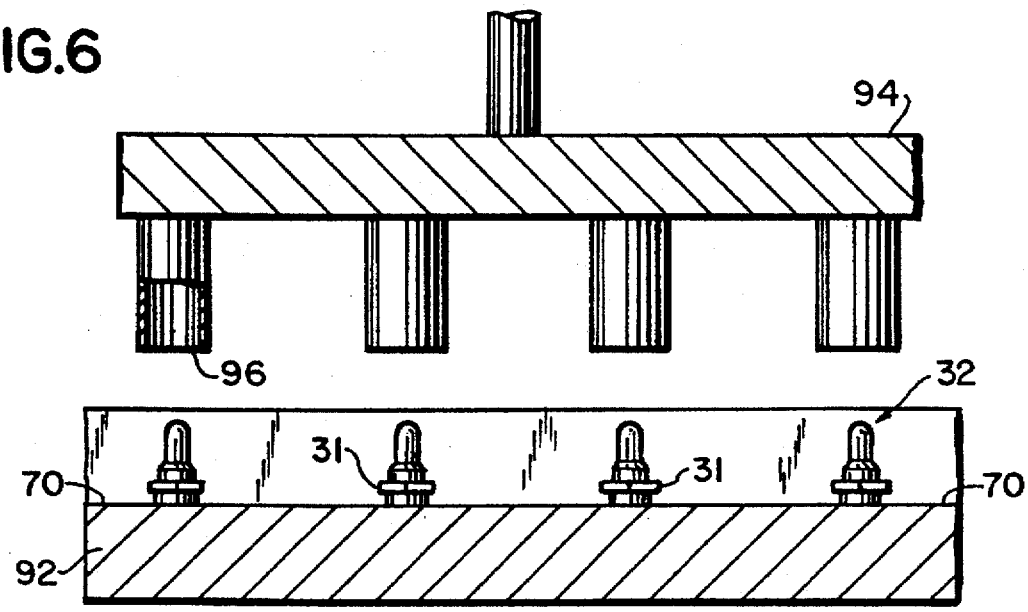
FIG. 6 is a perspective view of one possible method for cutting each of the formed switch seals free of the thermoplastic sheet.

FIG. 6 illustrates one possible final step in the fabrication of the switch seals of the invention. The thermoformed film, having been peeled away from the mold, is now placed on a flat bed plate 92 beneath a flat bed press 94, such as, for example, a "clicker press". A multiplicity of cutting circles 96 within the die now contact the flat bed plate 92, cutting a circle about each of the shaped forms and nuts within the thermoformed sheet, thereby freeing each of the film coated nuts and their tubular film extensions from the remainder of the thermoformed film. The result the finished products as depicted in FIGS. 2 and Obviously other techniques for cutting the finished product free of the residual thermoformed film can be employed, such as, for example, cutting the finished product free of the film while the film is still connected to the mold, and so on.

Figure 7:
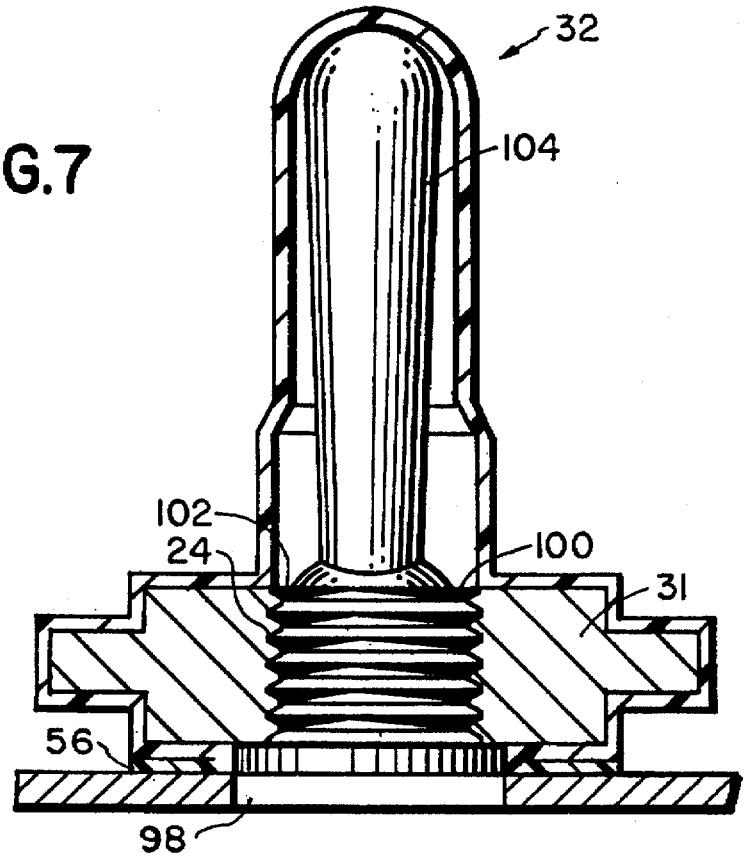
FIG. 7 is a perspective, sectional view of one version of the switch seal of the invention in place over a toggle switch, with the encapsulated nut of the switch seal threaded onto the upstanding threaded flange at the base of the toggle switch.
Figure 7A:
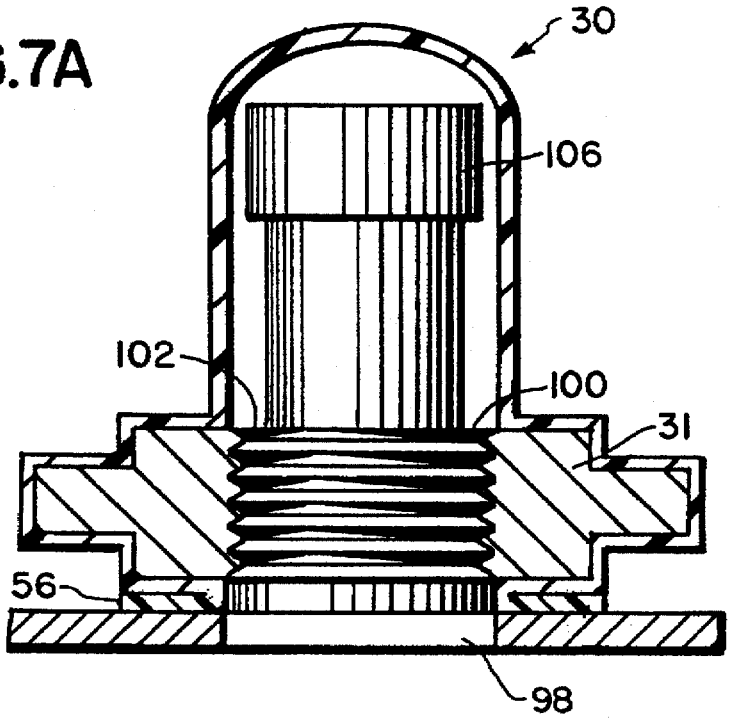
FIG. 7A is a similar view to that of FIG. 7, showing one version of the switch seal of the invention as secured to a push button type switch.

FIGS. 7 and ? A illustrate the final product of the switch seal fabrication method in actual use in typical switch sealing applications. In FIG. 7 the switch seal 32 configured for use with toggle switches is shown secured over a toggle switch. An externally threaded upstanding flange portion 100 of a toggle switch 104 is shown protruding through an opening in a panel 98. Matching internal threads 24 on the nut 31 are shown threaded over the external threads 102 of the flange 100. Threading the nut 31 and flange 100 together causes the film coated planar surface 39 at the base of the nut to contact the shelf 56 of film remaining after the mold releasing cutting process (as best seen in FIGS. 2 and 2A) to be compressed against the upper surface of the panel 98, thereby forming a highly reliable liquid and dust tight seal for the toggle switch. It is to be noted that even if the descending vertical wall of film 54 and shelf of film 56 at the base of the switch seal (FIGS. 2 and 2A) were removed, the coating of film on the exterior surface of the bottom planar surface 39 of the nut would still provide a reliable liquid and dust tight seal. However, leaving this descending vertical wall of film 54 and shelf of film 56 in place provides a double benefit-(1) eliminating a final trimming step adds to the overall economy of fabrication; (2) the additional shelf 56 of film provides a redundant safety feature in providing an extremely reliable liquid and dust tight seal. FIG. 7A is similar to FIG. 7, illustrating the switch seal 30 configured for use with push buttons 106 shown secured over a push button switch.

Thus the invention discloses a method for fabricating electric switch seals economically, and yet having superior features. Utilizing polyurethane as the film to be thermoformed, an extremely thin switch seal is provided that will not interfere with the proper functioning of the switches contained within them. At the same time, the great tensile and tear strength of polyurethane assures long life even under difficult operating conditions. In those applications where clear polyurethane film can be employed, the resultant seals add the advantage of clearly viewing the functioning of the switches enveloped by the seals.

While the present invention has been disclosed in connection with versions shown and describe in detailed, various modifications and improvements thereon will become readily apparent to those skilled in the art. Accordingly, the spirit and scope of the present invention is to be limited only by the following claims.

What is claimed is:

1. A thin seal for an electric switch, comprising:

(a) a unitary seal having a hollow cavity, said seal having an upper portion and a lower portion;

(b) a nut, said nut having an exterior surface and a threaded interior surface, said exterior surface including a polygonal external surface, said nut having a top planar surface and a bottom planar surface, said nut having an opening to said threaded interior surface of said nut;

(c) said lower portion encapsulating said exterior surface of said nut;

(d) said upper portion of said seal having upstanding side walls and an enclosed top portion, said upper portion being smaller in diameter than said opening to the interior threaded surface of said nut;

(e) said lower portion being larger in diameter to said opening to said interior threaded surface of said nut, said lower portion having an opening in its base portion at least as large as said opening to said interior threaded surface of said nut;

(f) said lower portion having an extension of said seal confluent with said bottom planar surface of said nut facing away from said upper portion of said seal, said extension being positioned a spaced distance below and in a parallel plane with said bottom planar surface of said nut, said extension forming a redundant liquid and dust tight seal when said seal is in place on said electric switch; and (g) said seal being formed by placing said nut on a vertically positioned pin having an upper first section configured in a desired shape of said upper portion of said seal, said upper first section of said pin having a diameter smaller than said opening to said interior threaded surface of said nut, said pin having a lower second section having a diameter larger than said opening to said interior threaded surface of said nut, said pin extending upwards from a planar surfaced mold, said nut being held a spaced distance above said planar surface of said mold by a shoulder formed at a junction of said first and second sections of said pin by said different diameters of said first and second sections of said pin, then placing a thin sheet of polyurethane plastic over a top portion of said nut, vacuum forming said sheet of plastic over said pin, thereby creating said thin electric switch seal by encapsulating the outer surface of said pin and said nut in a film of said sheet of plastic, then stripping said film off of said pin, and cutting said film at an area on said planar surface of said mold slightly larger than an area encompassed by said polygonal external surface of said nut at said shoulder of said pin so as to free said seal from remaining portions of said film, so that when said seal is secured to a flange on said electric switch with said switch extending upwards into said hollow cavity, said switch is free to move within said cavity without interference from said seal.

2. The electric switch seal according to claim 1 wherein said nut is a stamped nut.

3. The electric switch seal according to claim 1 wherein said thin sheet of polyurethane plastic has a maximum thickness of 0.020".

4. The electric switch seal according to claim 1 wherein said upstanding side walls of said upper portion of said seal define a cylindrical shape, and wherein said top portion of said upper portion of said seal is dome shaped, cooperating to provide a thin, protective, non-interfering envelope for a push button switch.

5. The electric switch seal according to according to claim 4 wherein said cylindrically shaped upper portion of said seal has a first section, said first section containing the dome shaped portion, having a substantially smaller diameter relative to the diameter of said opening to said interior threaded surface of said nut, further comprising a second section confluent with said first section cylindrically shaped upper portion, said second section of said cylindrically shaped upper portion having a larger diameter than said first section of said cylindrically shaped upper portion, but still a smaller diameter than said diameter of said opening in said nut, cooperating to form a thin, protective, non-interfering envelope for a toggle switch.

6. A thin seal for an electric switch comprising:

(a) a unitary seal having a hollow cavity, said seal having an upper portion and a lower portion;

(b) a nut, said nut having an exterior surface, including a polygonal external surface and a threaded interior surface, said nut having a top planar surface and a bottom planar surface, said nut having an opening to said threaded interior surface of said nut;

(c) said lower portion encapsulating said exterior surface of said nut;

(d) said upper portion of said seal having upstanding side walls and an enclosed top portion, said upper portion being smaller in diameter than said opening to said threaded interior surface of said nut;

(e) said lower portion being larger in diameter to said opening to said threaded interior surface of said nut, said lower portion having an opening in its base portion at least as large as said opening to said threaded interior of said nut;

(f) said seal being formed by placing said nut on a vertically positioned pin having an upper first section configured in a shape so as to conform with said upstanding side walls and said enclosed top portion of said upper portion of said unitary seal, said upper first section of said pin having a diameter smaller than said opening to said interior threaded surface of said nut, said pin having a lower second section having a diameter larger than said opening to said threaded interior surface of said nut, said pin extending upwards from a planar surfaced mold, said pin having a junction between said upper first section of said pin and said lower second section of said pin, said nut being held a spaced distance above said planar surface of said mold by a shoulder formed at said junction of said first and second sections of said pin, then placing a thin sheet of thermoplastic material over said pin at a position of said pin corresponding to said top portion of said upper portion of said unitary seal, vacuum forming said thin thermoplastic material over said pin, thereby creating said thin electric switch seal by encapsulating the outer surface of said pin and said nut in a film of said thermoplastic material, then stripping said film off of said pin, and cutting said film at an area on said planar surface of said mold slightly larger than an area encompassed by said polygonal external surface of said nut at said shoulder of said pin so as to free said seal from remaining portions of said film, so that when said seal is secured to a flange on said electric switch with said switch extending upwards into said hollow cavity, said switch is free to move within said cavity without interference from said seal; and (g) said electric switch seal further comprising an extension of said thermoplastic material confluent with said bottom planar surface of said nut facing away from said upper portion of said seal, said extension being positioned a spaced distance below and in a parallel plane with said bottom planar surface of said nut, said extension forming a redundant liquid and dust tight seal when said seal is in place on said electric switch.

* * * * *